US008784070B2

(12) United States Patent
Yokota et al.

(10) Patent No.: US 8,784,070 B2
(45) Date of Patent: Jul. 22, 2014

(54) AIR COMPRESSOR

(75) Inventors: Tomoyoshi Yokota, Hitachinaka (JP); Seiichi Kodato, Hitachinaka (JP); Kenichi Matsunaga, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 208 days.

(21) Appl. No.: 13/123,375

(22) PCT Filed: Oct. 9, 2009

(86) PCT No.: PCT/JP2009/067961

§ 371 (c)(1),
(2), (4) Date: Apr. 8, 2011

(87) PCT Pub. No.: WO2010/041774

PCT Pub. Date: Apr. 15, 2010

(65) Prior Publication Data

US 2011/0206538 A1 Aug. 25, 2011

(30) Foreign Application Priority Data

Oct. 9, 2008 (JP) ..... 2008-262398

(51) Int. Cl.
*F04B 49/06* (2006.01)

(52) U.S. Cl.
USPC ..... 417/44.2

(58) Field of Classification Search
CPC ..... F04B 49/022; F04B 2205/05
USPC ..... 417/44.1, 44.2
See application file for complete search history.

(56) References Cited

U.S. PATENT DOCUMENTS

| | | | | |
|---|---|---|---|---|
| 3,915,593 | A | 10/1975 | Chamberlain | |
| 4,135,860 | A | 1/1979 | van Nederkassel | |
| 4,756,669 | A * | 7/1988 | Hata | 417/12 |
| 7,476,088 | B2 * | 1/2009 | Iimura et al. | 417/44.2 |
| 2004/0191073 | A1 * | 9/2004 | Iimura et al. | 417/44.2 |
| 2004/0265134 | A1 | 12/2004 | Iimura et al. | |

FOREIGN PATENT DOCUMENTS

| | | |
|---|---|---|
| JP | 57-181982 | 11/1982 |
| JP | 59-158392 | 9/1984 |
| JP | 63-038693 A | 2/1988 |
| JP | 2004-100565 | 4/2004 |
| JP | 2004-300996 | 10/2004 |

OTHER PUBLICATIONS

Japanese Office Action issued in Japanese Patent Application No. 2008-262398 dated Apr. 18, 2013 with English Translation.

* cited by examiner

*Primary Examiner* — Peter J Bertheaud
(74) *Attorney, Agent, or Firm* — McDermott Will & Emery LLP

(57) ABSTRACT

When an air pressure in a tank part (5) drops from a maximum set pressure value (A1) to or below at least one restart set pressure value defined to lie in a range between the maximum set pressure value and a minimum set pressure value, a control circuit part (2) operates an electric motor (3*b*) at a predetermined revolving speed. When the air pressure in the tank part (5) drops from the restart set pressure value to or below the minimum set pressure value, the control circuit part (2) operates the electric motor (3*b*) at the predetermined revolving speed or a revolving speed lower than N2 until the air pressure in the tank part (5) reaches the maximum set pressure value.

2 Claims, 8 Drawing Sheets

AIR COMPRESSOR

RELATED APPLICATIONS

This application is the U.S. National Phase under 35 U.S.C. §371 of International Application No. PCT/JP2009/067961, filed on Oct. 9, 2009, which in turn claims the benefit of Japanese Application No. 2008-262398, filed on Oct. 9, 2008, the disclosures of which Applications are incorporated by reference herein.

TECHNICAL FIELD

The present invention relates to an air compressor which generates compressed air to drive a pneumatic tool, such as a nailing machine.

BACKGROUND ART

Generally, an air compressor to be used for a pneumatic tool converts the rotary motion of an electric motor into the reciprocating motion of a piston inside a cylinder via a crankshaft, compresses air sucked in from a suction valve by the reciprocating motion of the piston, and stores the compressed air in an air tank part from an exhaust valve of the cylinder, as disclosed in Patent Document 1 mentioned below. This air compressor is carried together with a pneumatic tool into a work site, such as a construction site. Then, the air compressor is used as a drive source to drive a nail or screw into a work member like a lumber by supplying the compressed air stored in the air tank part of the air compressor to a pneumatic tool (e.g., nailing machine) via an air hose.

As this air compressor is carried together with a pneumatic tool into an indoor or outdoor work site and supplies compressed air in the air tank part to the pneumatic tool via an air hose, the air compressor is generally of a portable type which has a relatively small-sized air tank. This portable air compressor has a relatively smaller capability of generating compressed air to be stored in the air tank as compared with a floor type air compressor, and is demanded of having as small an air tank as possible for excellent portability.

In the conventional air compressor, as disclosed in Patent Document 1, air sucked into the cylinder is compressed by the reciprocating motion of the piston, generating compressed air. The piston is driven by converting the rotary motion of the electric motor into reciprocating motion. Then, the air compressor stores higher compressed air into the air tank as the revolving speed of the electric motor is set higher by a control circuit which controls the rotary motion of the electric motor. In this case, a pressure sensor for converting compressed air into a voltage signal is installed in the air tank, and the control circuit acquires pressure (P) in the tank part from a detection signal from the pressure sensor.

When the pressure sensor detects that the pressure (P) in the tank part reaches a maximum set pressure value set as the upper limit for the purpose of safety, the control circuit stops operating the electric motor. If compressed air having an air pressure equal to or higher than the use limit pressure of a pneumatic tool is stored in the air tank, even when the pneumatic tool to be connected demands a larger amount of compressed air than can be produced by the generation capacity of the air compressor, it is possible to cope with the demand by discharging the compressed air in the air tank for a predetermined time.

When the pressure in the air tank drops to or below a predetermined restart set pressure value due to consumption of compressed air in the air tank, on the other hand, the control circuit restarts the electric motor to generate compressed air and store it in the air tank. Further, the control circuit detects a drop ($\Delta P$) of air pressure per a predetermined passed time ($\Delta T$) based on the detection signal from the pressure sensor to acquire a pressure drop rate ($\Delta P/\Delta T$) of the air in the tank. Then, the control circuit determines if the air consumed by the work with the pneumatic tool is large or small, and sets again the revolving speed of the electric motor and the set value of the restart pressure corresponding to the pressure drop rate ($\Delta P/\Delta T$). In this manner, the control circuit performs control to keep the air pressure in the air tank at the pressure which can be used by a pneumatic tool, thus ensuring efficient use of the pneumatic tool.

For example, in a pressure change curve diagram based on the control operation of the conventional air compressor as shown in FIG. 6B, an initial restart set pressure value (second restart set pressure value) is 3.2 MPa. In case of a large amount of air consumption, at the time of working, i.e., when the pressure drop rate ($\Delta P/\Delta T$) is large, a first restart set pressure value for generating compressed air is set to a high value, e.g., 4.0 MPa. Then, at a time point c where the pressure in the air tank drops to or below 4.0 MPa, the electric motor is operated at a relatively high revolving speed of, for example, 2600 rpm to start storing compressed air in the air tank early to cope with the large amount of air consumption. This secures the time of usage of the pneumatic tool till a time point d where the pressure drops to or below the capacity limit pressure (forced operation set pressure) of the air compressor.

In case of a small amount of air consumption in the air tank, i.e., when the pressure drop rate ($\Delta P/\Delta T$) is small, the set value of the restart pressure is set to 3.2 MPa smaller than the set value of 4.0 MPa. Until a time point h where the air pressure drops from the set value of 4.0 MPa to reach 3.2 MPa, the air compressor is not restarted and stands by. At the time point h where the air pressure drops to or below 3.2 MPa, the control circuit performs control to set the revolving speed N of the motor to a low revolving speed N3=1600 rpm to execute an operation of restoring compressed air.

In this manner, the control circuit operates the electric motor and the air compression part with the restart set pressure value and the revolving speed of the motor changed according to the size of pressure drop rate ($\Delta P/\Delta T$) of the amount of air consumption in the air tank. This can eliminate wasteful operations of the electric motor part and the piston part, thus making it possible to reduce wasteful power consumption and prevent wear-off or failure of the air compressor.

As an air compressor which is controlled by another conventional control system, there is known an air compressor which is configured to have a changeover switch capable of setting the revolving speed of the electric motor to one of a high revolving speed and a low revolving speed, regardless of the amount of air consumption in the air tank, so that a user of a pneumatic tool selects the changeover switch beforehand to set the operational condition.

[Patent Document 1] Unexamined Japanese Patent Application KOKAI Publication No. 2004-300996

SUMMARY OF INVENTION

Recently, a pneumatic tool such as a nailing machine, is demanded of long hours of continuous work, and there have appeared products having high drive powers. Accordingly, the amount of consumption of compressed air of pneumatic tools is increasing, and there is a demand for an air compressor in use which is excellent in the capacity of generating compressed air.

However, when the conventional air compressor as mentioned above is used to continuously use a pneumatic tool, as shown in FIG. 6B, the air pressure in the air tank drops to or below the use limit pressure of the pneumatic tool due to the insufficient capacity of the air compressor to generate compressed air. As a result, a worker should interrupt the operation of the pneumatic tool. When such a situation occurs, the worker interrupts the work with the pneumatic tool, and performs another work, such as set-up work, raising a problem of significantly lowering the working efficiency with the pneumatic tool.

To overcome the problem, according to the conventional control technique, as shown in FIG. 6B, when the air pressure in the air tank drops to or below the use limit pressure value of a pneumatic tool, the air compressor performs a forced operation at a relatively high revolving speed. Then, a worker interrupts a work with the pneumatic tool, and stands by until the air pressure in the air tank is restored to a predetermined air pressure value. Nevertheless, according to the related art as shown in FIG. 6B, when the air pressure in the air tank is restored to an operable decision area, the control circuit of the air compressor determines that there is not any amount of consumption of compressed air, and automatically changes the forced operation to a low revolving speed. Therefore, there is a shortcoming such that the restoration time for the pressure of compressed air in the air tank to reach the maximum set pressure value becomes longer.

According to the conventional another control system of changing the revolving speed of the electric motor of the air compressor to a high revolving speed or a low revolving speed, when the low-speed operation is selected for an energy-saving operation, the restoration time always become long. Accordingly, the restoration time becomes long for the workable quantity of a nailing machine or the like, raising a problem of significantly impairing the working efficiency. When a pneumatic tool which consumes a large amount of air is used, a high-speed operation is always selected as the operational revolving speed of the air compressor, which substantially disables the energy-saving operation.

Accordingly, it is an object of the present invention to overcome the foregoing problems and provide a portable air compressor suitable for use for a pneumatic tool which has a relatively large amount of consumption of compressed air.

It is another object of the invention to provide an air compressor which shortens the restoration time for restoring compressed air of a predetermined air pressure value into the air tank, thereby improving the working efficiency of a pneumatic tool, and enables energy-saving operation.

To achieve the objects, an air compressor according to the invention includes:

a tank part that stores compressed air to be supplied to a pneumatic tool;

a compressed-air generation part for generating the compressed air and supplying the compressed air to the tank part;

a drive part with a motor for driving the compressed-air generation part;

a pressure sensor for detecting an air pressure inside the tank part; and a control circuit part for controlling the motor of the drive part based on a detection signal from the pressure sensor, wherein the control circuit part stops operating the motor when detected pressure indicating the air pressure in the tank part acquired from the detection signal is higher than a maximum set pressure value, operates the motor when the detected pressure is lower than a minimum set pressure value lower than the maximum set pressure value, operates the motor at a first predetermined revolving speed when the detected pressure drops from the maximum set pressure value to or below at least one restart set pressure value defined to lie in a range between the maximum set pressure value and the minimum set pressure value, and operates the motor at the first predetermined revolving speed or at a second predetermined revolving speed higher than the first predetermined revolving speed until the detected pressure reaches the maximum set pressure value when the detected pressure is the same as or below the minimum set pressure value.

The restart set pressure value may include a first restart set pressure value and a second restart set pressure value lower than the first restart set pressure value, and the control circuit part may operate the motor at the first predetermined revolving speed when the detected pressure drops from the maximum set pressure value to or below the first restart set pressure value and when a pressure drop rate thereof is greater than a predetermined value, and may operate the motor at a third predetermined revolving speed lower than the first predetermined revolving speed when the detected pressure drops from the maximum set pressure value to or below the second restart set pressure value and when a pressure drop rate thereof is smaller than the predetermined value.

The control circuit part may operate the motor at the first predetermined revolving speed until the detected pressure reaches the maximum set pressure value when the detected pressure is equal to or lower than the minimum set pressure value.

The features of the invention make it possible to determine if the amount of consumption of compressed air in the air tank is large or small, and set the revolving speed of the electric motor for restoring compressed air according to the large/small amount of air consumption, thereby ensuring an energy-saving operation.

According to another feature of the invention, the forced operation of the electric motor at a constant revolving speed is carried out when the drop of air pressure in the air tank reaches to the minimum set pressure value corresponding to the use limit pressure of a pneumatic tool, so that the time for restoration of compressed air can be always set to a constant time. This can improve the working efficiency of using a pneumatic tool.

BEST MODE FOR CARRYING OUT THE INVENTION

Figure 1:
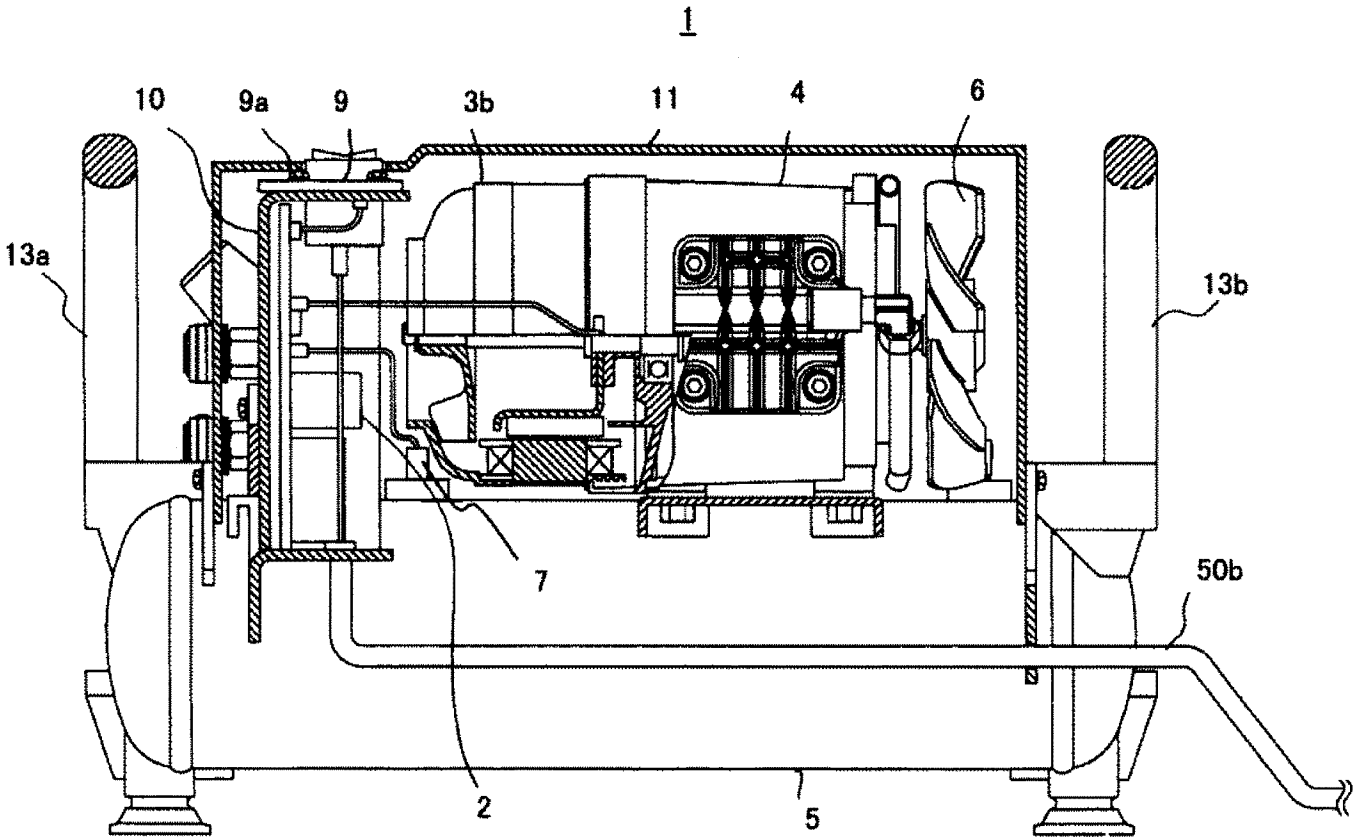
FIG. 1 is a partly cross-sectional side view showing the external appearance of an air compressor according to an embodiment of the present invention.

An embodiment of the present invention will be hereinafter described with reference to FIGS. 1 to 6. In all the diagrams illustrating the embodiment, common reference numerals are given to members having the same functions or elements to avoid their redundant descriptions.

Figure 2:
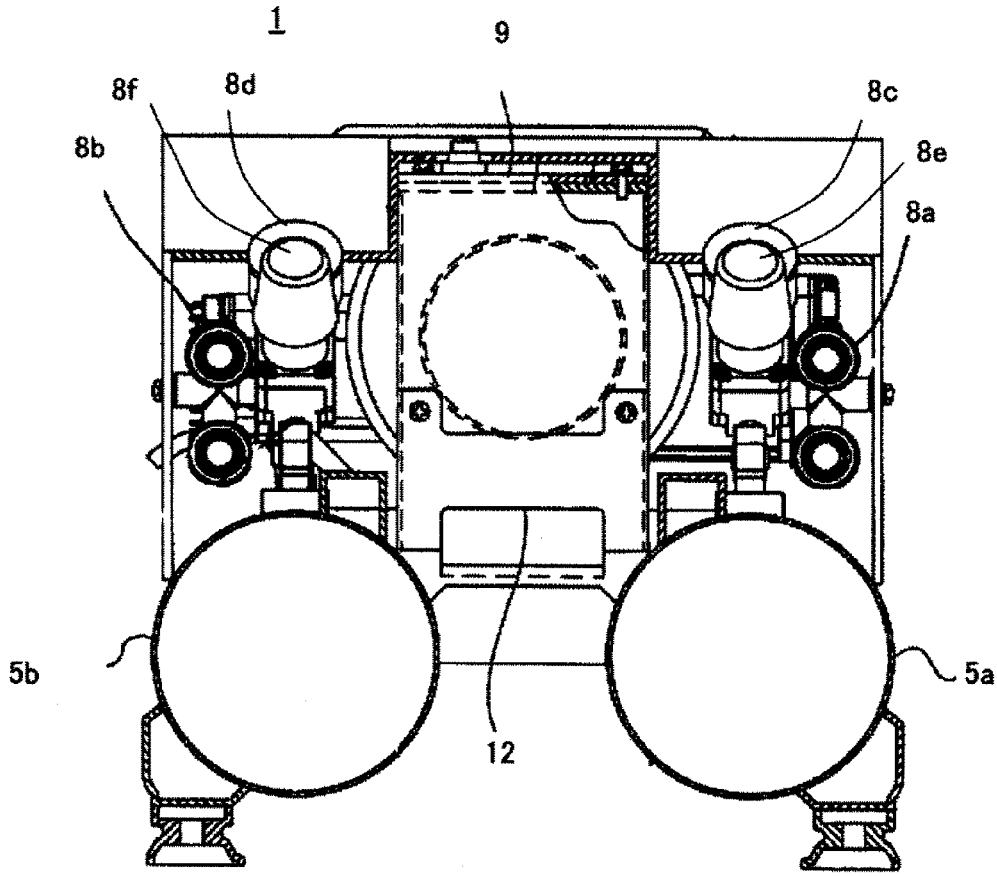
FIG. 2 is a partly cross-sectional front view showing the external appearance of the air compressor according to the embodiment of the invention.
Figure 3:
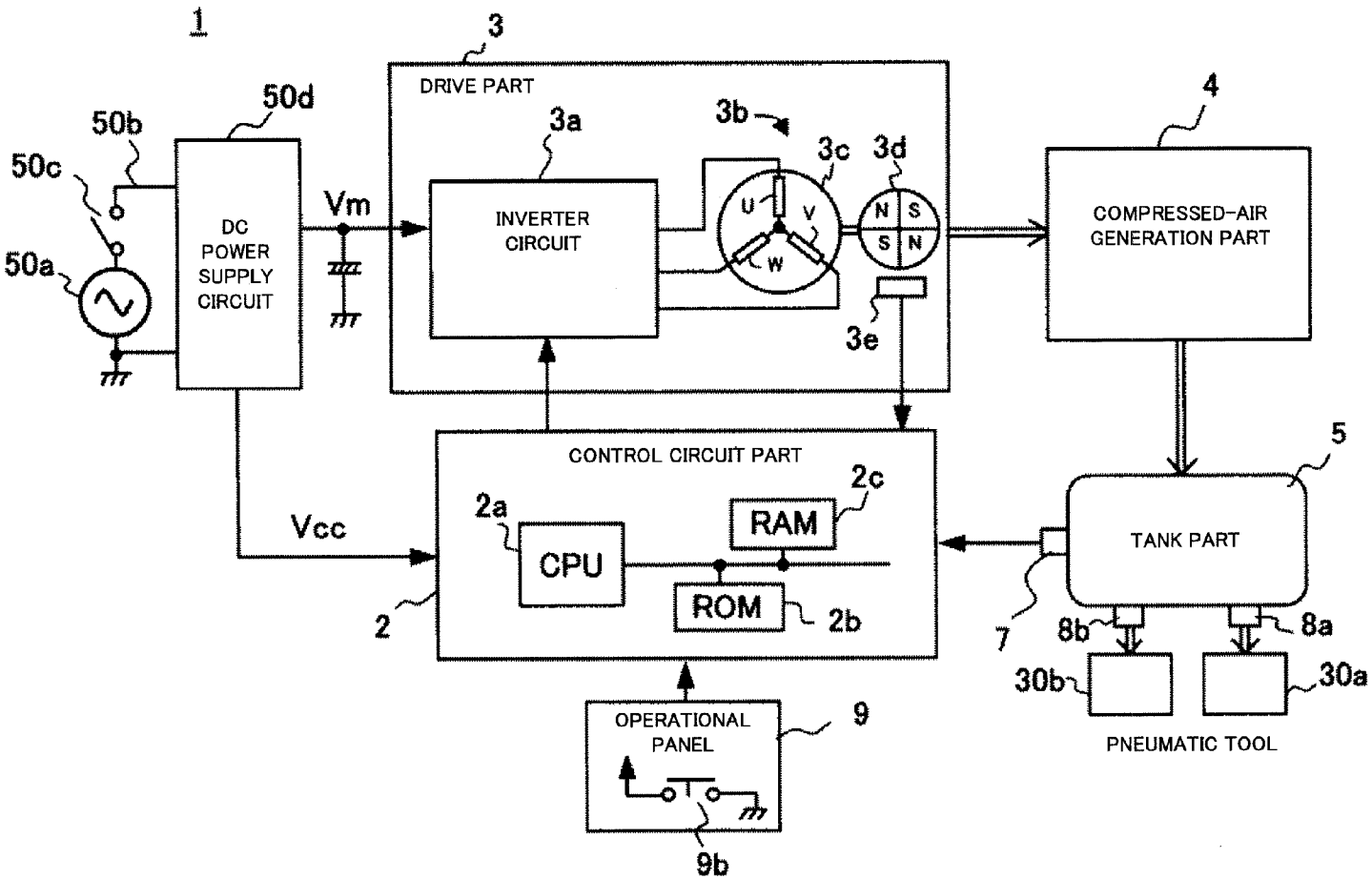
FIG. 3 is a block diagram showing the configuration of the air compressor according to the embodiment of the invention.

FIG. 1 and FIG. 2 show diagrams of the external appearance of an air compressor 1 according to this embodiment, and FIG. 3 shows a system block diagram of the air compressor 1.

As shown in FIG. 1, the air compressor 1 has a tank part 5 including a pair of tanks 5*a* and 5*b* formed in an elongated cylindrical shape for storing compressed air, a pressure sensor 7 (see FIG. 3) for detecting an air pressure inside the tanks 5*a*, 5*b*, a compressed-air generation part 4 which generates compressed air and supplies the compressed air to the tank part 5, a drive part 3 including an electric motor 3*b* for driving the compressed-air generation part 4, a control circuit part 2 disposed inside a cover 11 to control the activation/stop (ON/OFF) and the revolving speed of the electric motor 3*b* of the drive part 3, and a cooling fan 6 mounted to the rotary shaft of the electric motor 3*b* to cool the electric motor 3*b* and the compressed-air generation part 4 with air. The air compressor 1 is driven on a commercially available AC power (e.g., single-phase ACT power of 100V, 50/60 Hz) 50*a* (see FIG. 3) which is supplied via a power cord 50*b*.

The tank part 5 stores compressed air in the pair of cylindrical tanks 5*a*, 5*b* arranged in parallel. The compressed air is generated by the compressed-air generation part 4, and supplied to the tanks 5*a*, 5*b* from a discharge port thereof through an unillustrated connection pipe. The supplied compressed air has a pressure of, for example, 2.0 to 4.4 MPa within the tanks 5*a*, 5*b*.

A pair of compressed air takeout ports 8*a* and 8*b* are provided at a part of the tank part 5. The compressed air takeout ports 8*a*, 8*b* are connected to couplers (fluid couplings) via pressure reducing valves 8*e* and 8*f* (see FIG. 2), and are coupled to air hoses of pneumatic tools 30*a*, 30*b* (see FIG. 3), such as nailing machines, by the couplers.

The pressure reducing valves 8*e*, 8*f* have a function of suppressing the maximum pressure of the compressed air on the exit side (coupler side) to a constant level irrespective of the magnitude of the pressure of the compressed air in the tanks 5*a*, 5*b*. For example, in case where the maximum pressure of the pressure reducing valve 8*e*, 8*f* is 2.0 MPa, the pressure of the compressed air output from the pressure reducing valve 8*e*, 8*f* is equal to or less than 2.0 MPa even if the pressure inside the tank 5*a*, 5*b* is equal to or higher than 2.0 MPa. Therefore, compressed air having a pressure equal to or less than the maximum pressure of the pressure reducing valve 8*e*, 8*f* is obtained on the exit side of the pressure reducing valve 8*e*, 8*f*, irrespective of the pressure inside the tank 5*a*, 5*b*.

Pressure gauges 8*c* and 8*d* are mounted to the pressure reducing valves 8*e*, 8*f* to measure the pressures on the exit sides of the pressure reducing valves 8*e*, 8*f*.

The pressure sensor 7 is mounted to a part of the tank part 5 to detect the pressure of compressed air inside the tank 5*a*, 5*b*. A detection signal of the pressure is sent to the control circuit part 2 to be described later. The control circuit part 2 acquires the air pressure in the tank 5*a*, 5*b* as the detected pressure from the detection signal, and controls an inverter circuit 3*a* for starting or stopping the electric motor 3*b* of the drive part 3 shown in FIG. 3 based on the detection signal.

The compressed-air generation part 4 converts the rotary motion of the electric motor 3*b* of the drive part 3 into the reciprocatory motion of a piston in an unillustrated cylinder to compress air sucked into the cylinder from a suction vale of the cylinder, thus generating compressed air. The generated compressed air is discharged to the connection pipe (not shown) from an exhaust valve provided at a cylinder head, and stored into the tanks 5*a*, 5*b*. Such a compressed-air generation part (air compressor body) 4 can be constituted by a well-known technology.

The commercially available AC power 50*a* (see FIG. 3) is supplied to a power supply circuit 50*d* via a main switch 50*c*. The power supply circuit 50*d* includes a full-wave rectifying circuit (not shown) for rectifying the AC power, and supplies a drive voltage Vm of the electric motor and a DC power Vcc of the control circuit part 2, which will be described later.

The drive part 3 has the electric motor 3*b* which is, for example, a brushless motor, the inverter circuit 3*a* comprised of six unillustrated power TRSs (e.g., MOSFETs), and a revolving speed sensor 3*e* comprised of a Hall IC or the like. The electric motor 3*b* has a status 3*c* and a a rotor 3*d* made by a permanent magnet. The drive part 3 forms a rotary magnetic field by letting a 3-phase drive current to flow through windings U, V and W of the status 3*c* coupled in a Y pattern by means of the inverter circuit 3*a*. The revolving speed sensor 3*e* detects the revolving speed N of the rotor 3*d*, and inputs its detection signal to the control circuit part 2.

The control circuit part 2 forms a pulse control signal for driving the inverter circuit 3*a* inverter circuit 3*a*. When the pulse control signal is supplied to the inverter circuit 3*a* from the control circuit part 2, the motor 3*b* is activated. When the inverter circuit 3*a* is disabled by the control circuit part 2, on the other hand, the motor 3*b* is stopped. Further, the revolving speed of the rotor 3*d* of the motor 3*b* is controlled by setting the pulse width of the pulse control signal using PEM modulation signal as the pulse control signal. The revolving speed N of the rotor 3*d* is controlled by a control signal output to the inverter circuit 3*a* by the control circuit part 2 based on the detection signal from the revolving speed sensor 3*e*. According to the embodiment, the revolving speed N of the rotor 3*d* is set to, for example, a low revolving speed N3 (e.g., 1600 rpm) or a high revolving speed N2 (e.g., 2600 rpm).

The control circuit part 2 is made of a microcomputer including a central processing unit CPU 2*a* which executes a control program, a read-only memory ROM 2*b* which stores the control program for the CPU 2*a*, a random access memory RAM 2*c* which is used as the working area for the CPU, a temporal storage area for data, or the like. According to the embodiment, an EEPROM (Electrically Erasable Programmable ROM) which can rewrite a program to be stored is used as the ROM 2*b*. This microcomputer can be formed on a circuit board by a well-known semiconductor integrated circuit (IC) technology.

The detection signal from the pressure sensor 7 mounted to the tank part 5 is input to the control circuit part 2. The control circuit part 2 outputs a control signal for controlling the inverter circuit 3*a* by means of the CPU 2*a* based on the control program loaded in the ROM 2*b* and the data stored in the RAM 2*c*.

An operational panel 9 is provided to allow a worker to input setting information on the revolving speed or the like to the control circuit part 2. The operational panel 9 is mounted to a frame 10 by an attachment screw 9*a*. The operational panel 9 includes a main switch (ON switch) 9*c* (see FIG. 3) for outputting a start signal to the motor 3*b* of the drive part 3.

A body cover 11 covers the electric motor 3*b* and compressed-air generation part 4, disposed above the tank part 5, for the purpose of protection.

In the air compressor 1 configured in the above manner, the ROM 2*b* of the control circuit part 2 stores a stop set pressure value (maximum set pressure value) A1 (e.g., 4.4 MPa) indicating the maximum pressure value of compressed air storable in the tank 5*a*, 5*b*, a forced operation set pressure value (minimum set pressure value) X (e.g., 2.0 MPa) indicating the minimum pressure value in the tank 5*a*, 5*b* corresponding to the pressure value of the minimum required compressed air. The ROM 2*b* also stores a first restart set pressure value (first intermediate set pressure value) A2 (e.g., 4.0 MPa) which lies in the range between the maximum set pressure value A1 and the minimum set pressure value X, and second restart set pressure value (second intermediate set pressure value) A3 (e.g., 3.2 MPa) smaller than the first intermediate set pressure value A2. Further, the ROM 2*b* stores a set pressure drop rate (ΔPr/ΔTr) which is the reference for the control circuit part 2 to change the revolving speed of the electric motor 3*b*.

The control circuit part 2 (CPU 2*a*) enables the high-speed operation or low-speed operation of the electric motor 3*b* based on the amount of consumption of compressed air in the tank 5*a*, 5*b*. For example, with the operation of the electric motor 3*b* being stopped, when the air pressure value P in the tank 5*a*, 5*b* lies in the range between the first intermediate setting pressure value A2 and the second intermediate setting pressure value A3, and when a pressure drop rate (ΔP1/ΔT1) is greater than the set pressure drop rate (ΔPr/ΔTr) (when the amount of air consumption is large), the control circuit part 2 operates the electric motor 3*b* at the high revolving speed N2 (e.g., 2600 rpm). With the operation of the electric motor 3*b* being stopped, when the air pressure value P in the tank 5*a*, 5*b* is equal to or less than the second intermediate setting pressure value A3, and when a pressure drop rate (ΔP2/ΔT2) is greater than the set pressure drop rate (ΔPr/ΔTr) (when the amount of air consumption is small), the control circuit part 2 operates the electric motor 3*b* at the low revolving speed N3 (e.g., 1600 rpm).

Further, with the electric motor 3*b* operating at a high speed or a low speed, when the air pressure value P in the tank 5*a*, 5*b* is lower than the minimum set pressure value X, the control circuit part 2 forcibly operates the electric motor 3*b* at a revolving speed Nx equal to or higher than the high revolving speed N2. In the embodiment described below, the control circuit part 2 forcibly operates the electric motor 3*b* at the same revolving speed of 2600 rpm as the high revolving speed N2 (2600 rpm). However, the revolving speed Nx of the electric motor 3*b* in the forced operation mode may be set to a revolving speed (e.g., 3000 rpm) higher than the high revolving speed N2. The adequate revolving speed Nx may be set according to the contents of the work with a pneumatic tool or the amount of consumption of compressed air. This forced operation can shorten the standby time until the pressure value of compressed air in the tank 5*a*, 5*b* becomes the maximum set pressure value A1, thus improving the working efficiency with a pneumatic tool 30.

Figure 4:
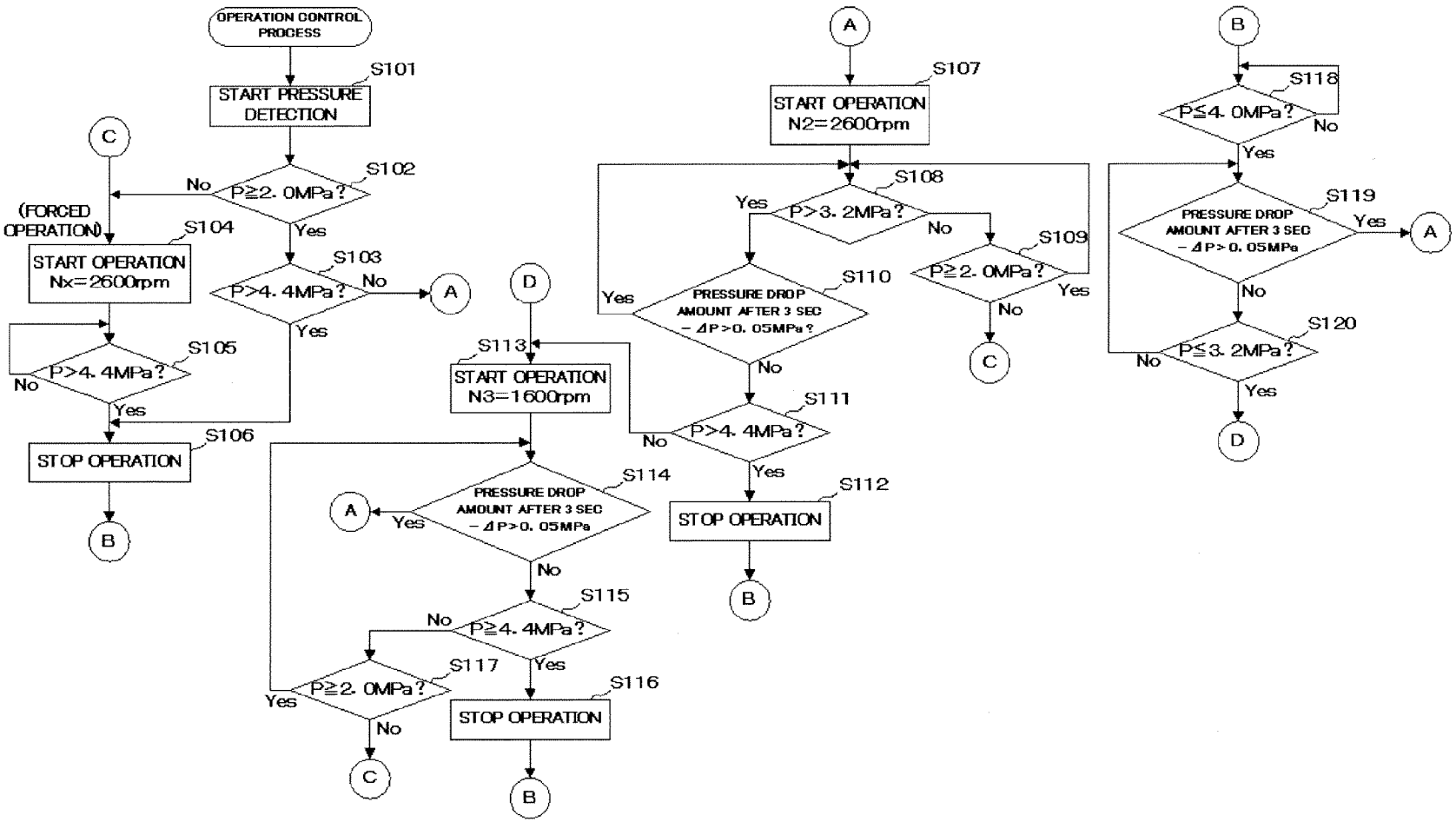
FIG. 4 is a flowchart of an operation control process which is executed by a control circuit part according to the embodiment of the invention.

Next, an operation control process based on an operation program stored in the ROM 2*b* of the control circuit part 2 of the air compressor 1 will be described referring to FIG. 4. The operation control process according to the embodiment mainly includes a start-up process, a normal operation process, and a standby process.

First, the start-up process will be described. The operation control process (start-up process) is initiated when the main switch 50*c* (see FIG. 3) is set on to supply power to the control circuit part 2 (CPU 2*a*). Then, the control circuit part 2 starts sampling the air pressure value P in the tank 5*a*, 5*b* using the pressure sensor 7 (step S101). At this time, the control circuit part 2 samples the detection signal from the pressure sensor 7 every 0.5 sec, for example.

Next, the control circuit part 2 discriminates whether or not the air pressure value P in the tank 5*a*, 5*b* detected by the pressure sensor 7 is equal to or greater than the minimum set pressure value X=2.0 MPa (step S102).

When the control circuit part 2 discriminates that the air pressure value P in the tank 5*a*, 5*b* is equal to or greater than 2.0 MPa (step S102; Yes), the control circuit part 2 discriminates whether or not the air pressure value P in the tank 5*a*, 5*b* is higher than the maximum set pressure value A1=4.4 MPa (step S103).

When the control circuit part 2 discriminates that the air pressure value P in the tank 5*a*, 5*b* is higher than 4.4 MPa (step S103; Yes), the control circuit part 2 stops operating the electric motor 3*b* (step S106). Then, the control circuit part 2 proceeds the process to step S118 to start the standby process.

When the control circuit part 2 discriminates that the air pressure value P in the tank 5*a*, 5*b* is not equal to or greater than 2.0 MPa, i.e., the air pressure value P is less than 2.0 MPa (step S102; No), the control circuit part 2 starts the forced operation of the electric motor 3*b* (step S104). That is, when the forced operation is started, the motor 3*b* is operated at a constant high revolving speed (2600 rpm) maintained, so that the pressure value reaches 4.4 MPa or the maximum set pressure value A1 faster. Although the revolving speed Nx of the electric motor 3*b* in the forced operation mode is set to 2600 rpm according to the embodiment, a revolving speed equal to or greater than 2600 rpm ma be set.

The control circuit part 2 discriminates whether or not the air pressure value P in the tank 5*a*, 5*b* is higher than the maximum set pressure value A1=4.4 MPa (step S105).

When the control circuit part 2 discriminates that the air pressure value P in the tank 5*a*, 5*b* is higher than 4.4 MPa (step S105; Yes), the control circuit part 2 stops operating the electric motor 3*b* (step S106). Then, the control circuit part 2 proceeds the process to step S118 to start the standby process. When the control circuit part 2 discriminates that the air pressure value P in the tank 5*a*, 5*b* is not higher than 4.4 MPa, i.e., the air pressure value P is equal to or less than 4.4 MPa (step S105; No), the control circuit part 2 stands by until the air pressure value P becomes higher than 4.4 MPa.

When the control circuit part 2 discriminates that the air pressure value P in the tank 5*a*, 5*b* is not higher than 4.4 MPa, i.e., the air pressure value P is equal to or less than 4.4 MPa (step S103; No), the control circuit part 2 proceeds the process to step S107 to start the normal operation process.

Next, the normal operation process will be described. When the control circuit part 2 discriminates in step S102 and S103 that the air pressure value P fulfills 2.0 MPa≤P≤4.0 MPa, the control circuit part 2 starts the high-speed operation of the electric motor 3*b* (step S107). The revolving speed N2 of the electric motor 3*b* in the high-speed operation mode is set to 2600 rpm according to the embodiment.

The control circuit part 2 discriminates whether or not the air pressure value P in the tank 5*a*, 5*b* is higher than 3.2 MPa or the second intermediate set pressure value A3 (step S108). When the control circuit part 2 discriminates that the air pressure value P in the tank 5*a*, 5*b* is not higher than 3.2 MPa, i.e., the air pressure value P is equal to or less than 3.2 MPa (step S108; No), the control circuit part 2 discriminates whether or not the air pressure value P in the tank 5*a*, 5*b* is equal to or greater than the minimum set pressure value X=2.0 MPa (step S109).

When the control circuit part 2 discriminates that the air pressure value P in the tank 5*a*, 5*b* is equal to or greater than 2.0 MPa (step S109; Yes), the control circuit part 2 returns the process to step S108. When the control circuit part 2 discriminates that the air pressure value P in the tank 5*a*, 5*b* is not equal to or greater than 2.0 MPa, i.e., the air pressure value P is less than 2.0 MPa (step S109; No), the control circuit part 2 starts the forced operation of the electric motor 3*b* (step S104).

When the control circuit part 2 discriminates that the air pressure value P in the tank 5*a*, 5*b* is higher than 3.2 MPa (step S108; Yes), the control circuit part 2 discriminates whether or not the amount of pressure drop −ΔP after a predetermined time ΔT=3 sec is greater than 0.05 MPa or the set pressure drop rate (step S110). Here, the pressure drop amount −ΔP is calculated by $-\Delta P=-\{P(t+\Delta T)-P(t)\}=P(t)-P(t+\Delta T)$ from $\Delta P=P(t+\Delta T)-P(t)$ as the difference between a pressure P(t) at a given point and a pressure P(t+ΔT) at the predetermined time ΔT=3 sec.

When the control circuit part 2 discriminates that the pressure drop amount −ΔP after the predetermined time ΔT=3 sec is not greater than 0.05 MPa, i.e., the pressure drop amount −ΔP is equal to or less than 0.05 MPa (step S110; No), the control circuit part 2 discriminates whether or not the air pressure value P in the tank 5*a*, 5*b* is higher than the maximum set pressure value A1=4.4 MPa (step S111).

When the control circuit part 2 discriminates that the air pressure value P in the tank 5*a*, 5*b* is higher than 4.4 MPa (step S111; Yes), the control circuit part 2 stops operating the electric motor 3*b* (step S112). Then, the control circuit part 2 proceeds the process to step S118 to start the standby process.

When the control circuit part 2 discriminates that the pressure drop amount −ΔP after the predetermined time ΔT=3 sec is greater than 0.05 MPa (step S110; Yes), the control circuit part 2 returns the process to step S108.

When the control circuit part 2 discriminates that the air pressure value P in the tank 5*a*, 5*b* is not higher than 4.4 MPa, i.e., the air pressure value P is equal to or less than 4.4 MPa (step S111; No), the control circuit part 2 starts the low-speed operation of the electric motor 3*b* (step S113). The revolving speed N3 of the electric motor 3*b* in the low-speed operation mode is set to 1600 rpm according to the embodiment.

The control circuit part 2 discriminates whether or not the pressure drop amount −ΔP after the predetermined time ΔT=3 sec is greater than 0.05 MPa (step S114). Here, the pressure drop amount −ΔP is calculated in the same way as done in step S110.

When the control circuit part 2 discriminates that the pressure drop amount −ΔP after the predetermined time ΔT=3 sec is greater than 0.05 MPa (step S114; Yes), the control circuit part 2 proceeds the process to step S107 to start the high-speed operation of the electric motor 3*b*.

When the control circuit part 2 discriminates that the pressure drop amount −ΔP after the predetermined time ΔT=3 sec is not greater than 0.05 MPa, i.e., the pressure drop amount −ΔP is equal to or less than 0.05 MPa (step S114; No), the control circuit part 2 discriminates whether or not the air pressure value P in the tank 5*a*, 5*b* is higher than the maximum set pressure value A1=4.4 MPa (step S115).

When the control circuit part 2 discriminates that the air pressure value P in the tank 5*a*, 5*b* is higher than 4.4 MPa (step S115; Yes), the control circuit part 2 stops operating the electric motor 3*b* (step S116). Then, the control circuit part 2 proceeds the process to step S118 to start the standby process.

When the control circuit part 2 discriminates that the air pressure value P in the tank 5*a*, 5*b* is not higher than 4.4 MPa, i.e., the air pressure value P is equal to or less than 4.4 MPa (step S115; No), the control circuit part 2 discriminates whether or not the air pressure value P in the tank 5*a*, 5*b* is equal to or greater than the minimum set pressure value X=2.0 MPa (step S117).

When the control circuit part 2 discriminates that the air pressure value P in the tank 5*a*, 5*b* is equal to or greater than 2.0 MPa (step S117; Yes), the control circuit part 2 returns the process to step S114. When the control circuit part 2 discriminates that the air pressure value P in the tank 5*a*, 5*b* is not equal to or greater than 2.0 MPa, i.e., the air pressure value P is less than 2.0 MPa (step S117; No), the control circuit part 2 starts the forced operation of the electric motor 3*b* (step S104).

Next, the standby process will be described. The control circuit part 2 stops operating the electric motor 3*b* in steps S106, S109, S112 and S116, and then discriminates whether or not the air pressure value P in the tank 5*a*, 5*b* is equal to or less than the first intermediate set pressure value A2=4.0 MPa (step S118). When the control circuit part 2 discriminates that the air pressure value P in the tank 5*a*, 5*b* is not equal to or less than 4.0 MPa, i.e., the air pressure value P is higher than 4.0 MPa (step S118; No), the control circuit part 2 stands by until the air pressure value P becomes equal to or less than 4.0 MPa.

When the control circuit part 2 discriminates that the air pressure value P in the tank 5*a*, 5*b* is lower than 4.0 MPa (step S118; Yes), the control circuit part 2 discriminates whether or not the pressure drop amount −ΔP after the predetermined time ΔT=3 sec is greater than 0.05 MPa (step S119). Here, the pressure drop amount −ΔP is calculated in the same way as done in step S110.

When the control circuit part 2 discriminates that the pressure drop amount −ΔP after the predetermined time ΔT=3 sec is greater than 0.05 MPa (step S119; Yes), the control circuit part 2 proceeds the process to step S107 to start the normal operation process.

When the control circuit part 2 discriminates that the pressure drop amount −ΔP after the predetermined time ΔT=3 sec is not greater than 0.05 MPa, i.e., the pressure drop amount −ΔP is equal to or less than 0.05 MPa (step S119; No), the control circuit part 2 discriminates whether or not the air pressure value P in the tank 5*a*, 5*b* is equal to or less than the second intermediate set pressure value A3=3.2 MPa (step S120). When the control circuit part 2 discriminates that the air pressure value P in the tank 5*a*, 5*b* is not equal to or less than 3.2 MPa, i.e., the air pressure value P is higher than 3.2 MPa (step S120; No), the control circuit part 2 stands by until the air pressure value P becomes equal to or less than 3.2 MPa.

When the control circuit part 2 discriminates that the air pressure value P in the tank 5*a*, 5*b* is equal to or less than 3.2 MPa (step S120; Yes), the control circuit part 2 proceeds the process to step S13 to start the low-speed operation of the electric motor 3*b*.

Figure 5A:
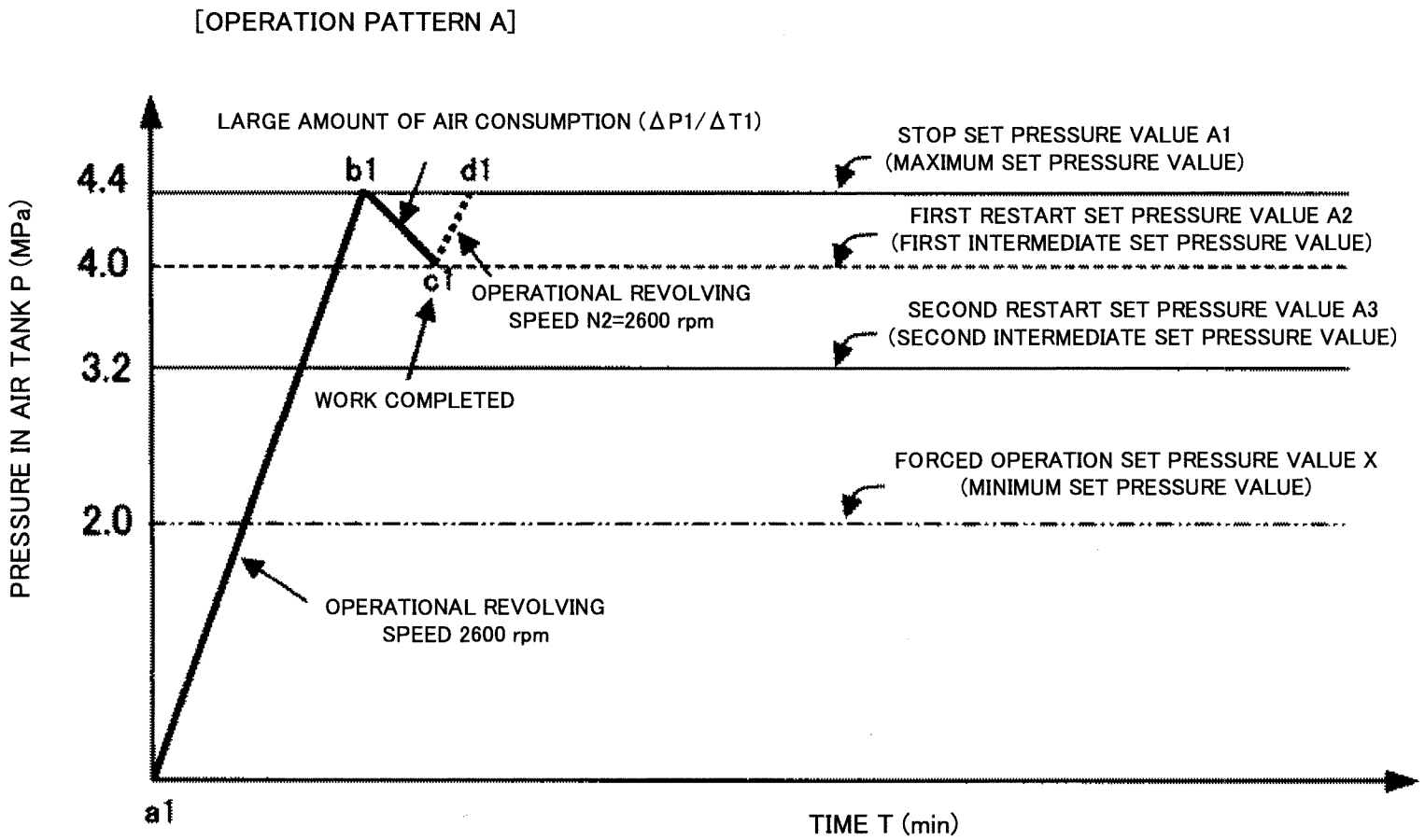
FIGS. 5A and 5B are pressure change curve diagrams for explaining an operational example of the air compressor according to the embodiment of the invention.
Figure 5B:
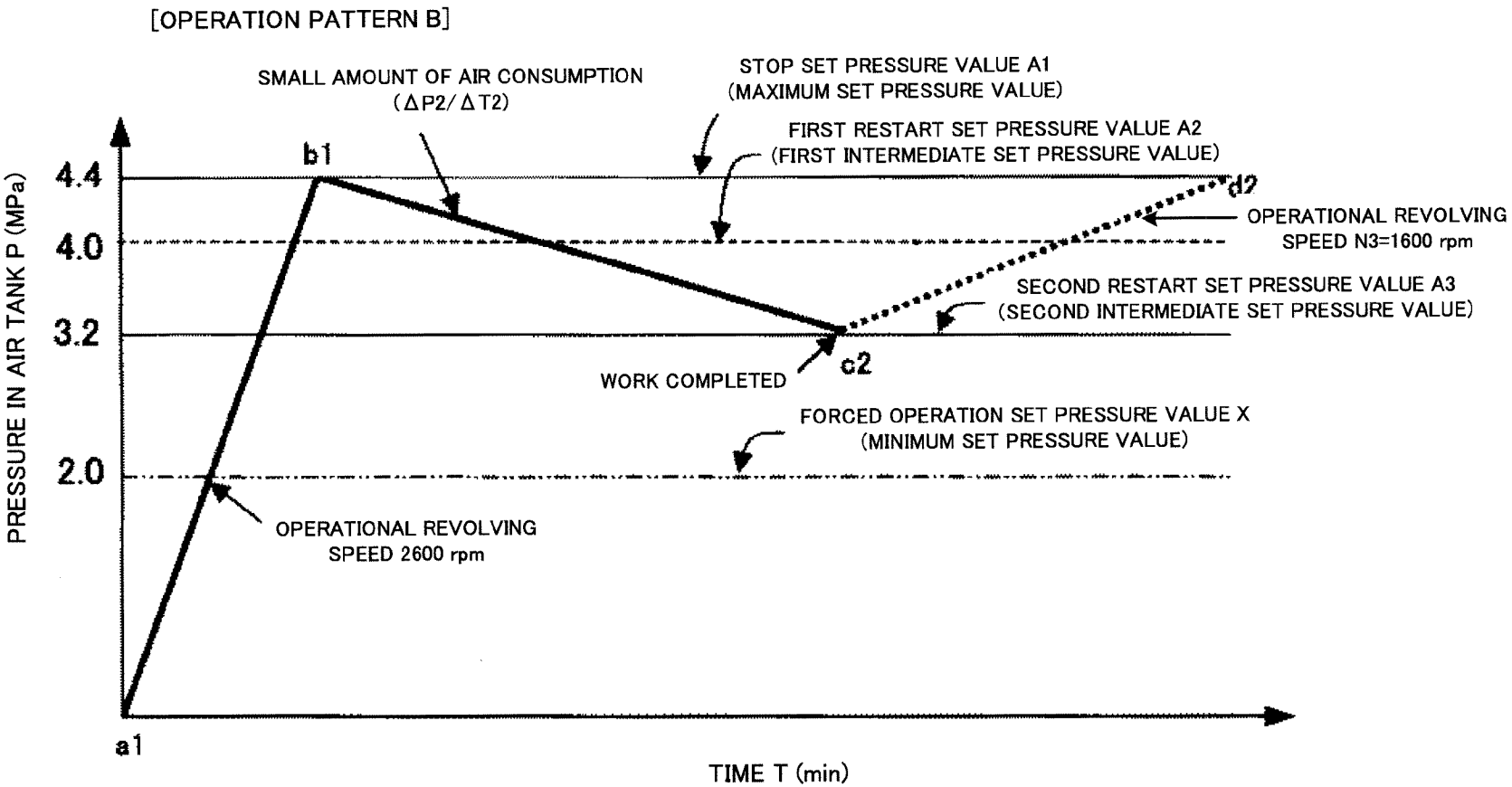
Figure 6A:
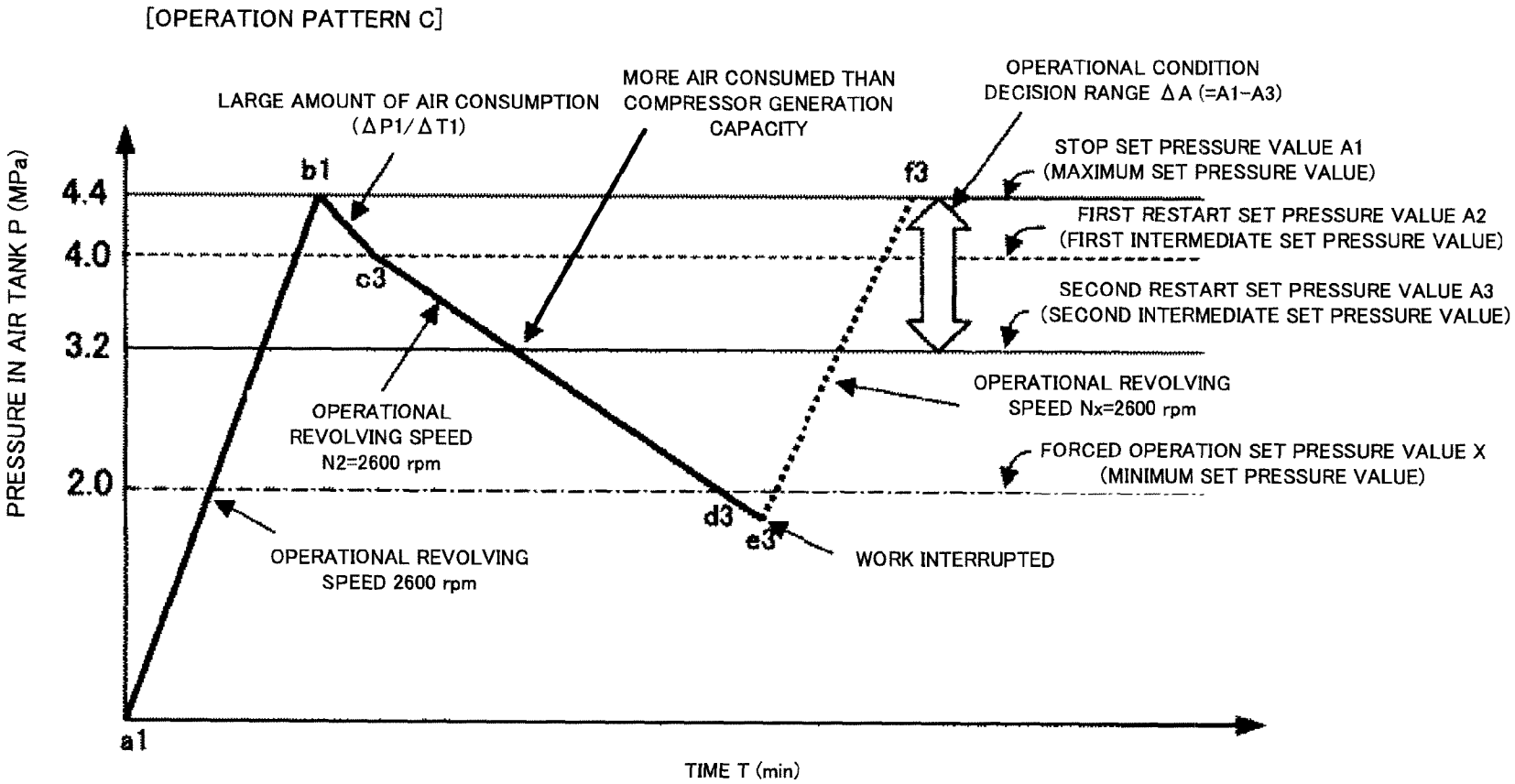
FIG. 6A is a pressure change curve diagram for explaining an operational example of the air compressor according to the embodiment of the invention.

Next, operation patterns A to C which are operational examples of the air compressor 1 according to the flowcharts of the operation control process in FIGS. 4 to 6 will be described referring to FIGS. 5 and 6. FIGS. 7A and 7B, and FIG. 6A are diagrams showing pressure change curves of the pressure P in the tank 5*a*, 5*b* at time T in the individual operation patterns.

To begin with, the operation pattern A will be described. As shown in FIG. 5A, the air compressor 1 is activated at a time a1. Because the air pressure value P in the tank 5*a*, 5*b* is lower than the minimum set pressure value X=2.0 MPa, the air compressor 1 starts the forced operation of the electric motor 3*b* at the revolving speed Nx=2600 rpm. When the air pressure value P in the tank 5*a*, 5*b* reaches the maximum set pressure value A1=4.4 MPa at a time b1, the air compressor 1 stops operating the electric motor 3*b*.

From a time b1 to a time c1, the worker consumes compressed air in the tank 5*a*, 5*b* by using the pneumatic tool 30, so that the air pressure value P in the tank 5*a*, 5*b* drops. At this time, the ratio of consumption of compressed air (pressure drop rate ΔP1/ΔT1) from the time b1 to the time c1 is greater than the set pressure drop rate (ΔPr/ΔTr) stored in the ROM 2*b* for the amount of consumption of air of the pneumatic tool or the number of times the pneumatic tool is used in, for example, a single nailing operation is large. When the air pressure value P in the tank 5*a*, 5*b* reaches the first intermediate set pressure value A2=4.0 MPa at the time c1, therefore, the air compressor 1 starts the high-speed operation of the electric motor 3*b* at the revolving speed N2=2600 rpm.

The air pressure value P in the tank 5*a*, 5*b* rises from the time c1 to a time d1. When the air pressure value P reaches the maximum set pressure value A1=4.4 MPa at the time d1, the air compressor 1 stops operating the electric motor 3*b*. From the time c1 to the time d1, it is assumed that the pneumatic tool 30 has not bee used, i.e., the compressed air in the tank 5*a*, 5*b* has not been consumed.

Next, the operation pattern B will be described. As shown in FIG. 5B, the air compressor 1 is activated at the time a1. Then, the air compressor 1 starts the forced operation of the electric motor 3*b* as in the operation pattern A, and stops operating the electric motor 3*b* when the air pressure value P in the tank 5*a*, 5*b* reaches the maximum set pressure value A1=4.4 MPa at the time b1.

From the time b1 to a time c2, the ratio of consumption of compressed air (pressure drop rate ΔP1/ΔT1) from the time b1 to the time c2 is smaller than the set pressure drop rate (ΔPr/ΔTr) stored in the ROM 2*b* for the amount of consumption of air of the pneumatic tool or the number of times the pneumatic tool is used in, for example, a single nailing operation is small. When the air pressure value P in the tank 5*a*, 5*b* reaches the second intermediate set pressure value A3=3.2 MPa at the time c2, therefore, the air compressor 1 starts the low-speed operation of the electric motor 3*b* at the revolving speed N3=1600 rpm.

The air pressure value P in the tank 5*a*, 5*b* rises from the time c2 to a time d2. When the air pressure value P reaches the maximum set pressure value A1=4.4 MPa at the time d2, the air compressor 1 stops operating the electric motor 3*b*. From the time c2 to the time d2, it is assumed that the pneumatic tool 30 has not bee used, i.e., the compressed air in the tank 5*a*, 5*b* has not been consumed.

Next, the operation pattern C will be described in comparison with the operation pattern of the conventional air compressor. As shown in FIG. 6A, the air compressor 1 is activated at the time a1. Then, the air compressor 1 starts the forced operation of the electric motor 3*b* as in the operation pattern A, and stops operating the electric motor 3*b* when the air pressure value P in the tank 5*a*, 5*b* reaches the maximum set pressure value A1=4.4 MPa at the time b1.

From the time b1 to a time c3, the ratio of consumption of compressed air (pressure drop rate ΔP1/ΔT1) is greater than the set pressure drop rate (ΔPr/ΔTr) stored in the ROM 2*b*. When the air pressure value P in the tank 5*a*, 5*b* reaches the first intermediate set pressure value A2=4.0 MPa at the time c3, therefore, the air compressor 1 starts the high-speed operation of the electric motor 3*b* at the revolving speed N2=2600 rpm.

From the time c3 to a time d3, compressed air greater than the capacity of the compressed-air generation part 4 of generating compressed air is continuously consumed, i.e., the amount of consumption of compressed air by the use of the pneumatic tool 30 is greater than the amount of compressed air to be supplied to the tank 5*a*, 5*b* from the compressed-air generation part 4, so that the air pressure value P in the tank 5*a*, 5*b* drops. Then, the air pressure value P in the tank 5*a*, 5*b* reaches the minimum set pressure value X=2.0 MPa at the time d3. In the conventional air compressor, as in the air compressor 1 according to the embodiment, the pressure in the tank drops and the air pressure value P in the tank reaches the minimum set pressure value of 2.0 MPa.

Because the air pressure value P in the tank 5*a*, 5*b* is lower than the minimum set pressure value X=2.0 MPa at a time e3, the worker can no longer perform the nailing work using the pneumatic tool 30, and thus stops using the pneumatic tool 30. Because the air pressure value P in the tank 5*a*, 5*b* is lower than the minimum set pressure value X=2.0 MPa, the air compressor 1 starts the forced operation of the electric motor 3*b* at the revolving speed Nx=2600 rpm.

Figure 6B:
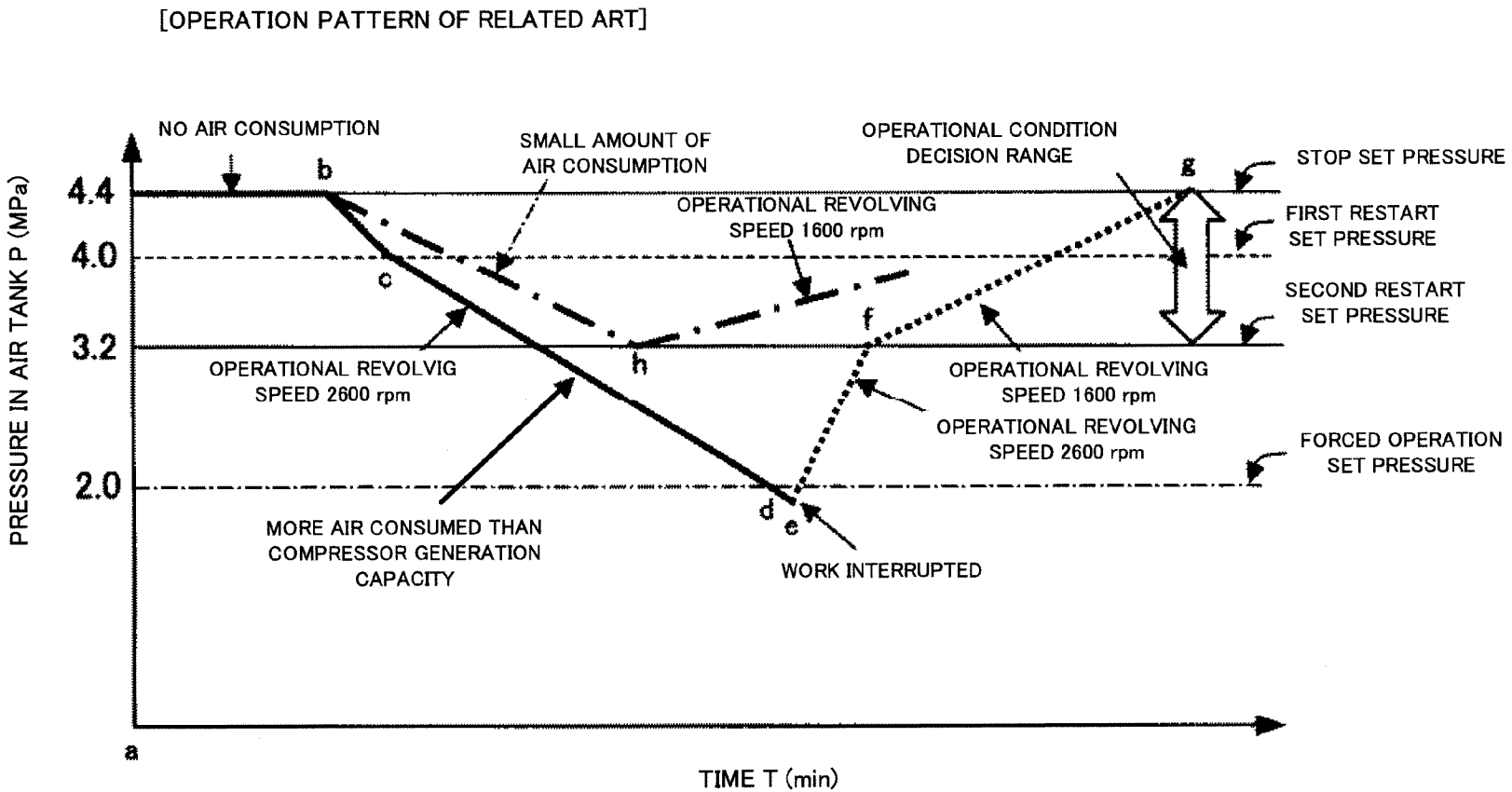
FIG. 6B is a pressure change curve diagram for explaining an operational example of the conventional air compressor.

The air pressure value P in the tank 5*a*, 5*b* rises from the time e3 to a time f3. When the air pressure value P reaches the maximum set pressure value A1=4.4 MPa at the time f3, the air compressor 1 stops operating the electric motor 3*b*. According to the conventional air compressor, as shown in FIG. 6B, the air pressure in the tank decreases between the times b to e as in the air compressor 1 according to the embodiment between the times b1 to e3. At the time e, the conventional air compressor starts the forced operation of the electric motor at the revolving speed of 2600 rpm. However, the air pressure value in the tank reaches the second restart set pressure value at the time f, and the pressure rises, so that the conventional air compressor starts the low-speed operation of the electric motor at the revolving speed of 1600 rpm. Therefore, the compressed-air restoration time (times e3 to f3) of the air compressor 1 according to the embodiment from the interruption of the work till the pressure in the tank reaches the stop set pressure value A1 is made shorter than the restoration time (times e to g) of the conventional air compressor.

As described above, in case of a large pressure drop rate, the air compressor 1 according to the embodiment starts the high-speed operation of the electric motor 3*b* when the air pressure value P in the tank 5*a*, 5*b* reaches the first intermediate set pressure value A2 in the range between the maximum set pressure value A1 and the minimum set pressure value X. It is therefore possible to prolong the time until the air pressure value in the tank 5*a*, 5*b* becomes lower than the minimum set pressure value, so that the time of use of the pneumatic tool can be prolonged, and the working efficiency can be improved.

When the amount of consumption of compressed air per unit time is small, the air compressor 1 according to the embodiment starts the low-speed operation of the electric motor 3*b* when the air pressure value P in the tank 5*a*, 5*b* lies between the maximum set pressure value A1 and the minimum set pressure value X, and reaches the second intermediate set pressure value A3 smaller than first intermediate set pressure value A2. It is therefore possible to reduce the frequency of the operation of the electric motor 3*b*, so that the power consumption of air compressor 1 can be reduced. In addition, it is possible to reduce wear-off or failure of the air compressor 1.

Moreover, when the compressed air which is greater than provided by the compressed air generating capacity of the compressed-air generation part 4 is continuously consumed so that the air pressure value P in the tank 5*a*, 5*b* reaches the minimum set pressure value X=2.0 MPa, the air compressor 1 according to the embodiment forcibly operates the electric motor 3*b* until the air pressure value P in the tank 5*a*, 5*b* reaches the maximum set pressure value A1=4.4 MPa. Therefore, the worker can predict the time from the interruption of a work caused by the air pressure value P in the tank 5*a*, 5*b* becoming smaller than the minimum set pressure value X till the completion of the restoration of compressed air in the tank 5*a*, 5*b*. Accordingly, the worker can efficiently use the working time. In addition, the working efficiency can be further improved by adequately setting the revolving speed Nx of the electric motor 3*b* in the forced operation according to the amount of consumption of compressed air.

The present invention is not limited to the embodiment of the invention described above.

Although the sampling period of the pressure in the tank 5*a*, 5*b* which is detected by the pressure sensor 7 is 0.5 sec according to the embodiment, the value is not restrictive and may take another value. Although the detection time for obtaining the amount of pressure drop is 3 sec according to the embodiment, the value is not restrictive and may take another value.

The invention may be embodied and modified in various forms without departing from the spirit or scope of the invention. The present embodiment is to be considered as illustrative and not restrictive. That is, the scope of the invention is not to be limited to the embodiment, but may be indicated by the scope of the appended claims. Various modifications which are made within the scope of the claims and within the meaning of an equivalent of the claims of the invention are to be regarded to be in the scope of the invention.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Application No. 2008-262398 filed on Oct. 9, 2008. The specification, claims, and drawings of Japanese Patent Application No. 2008-262398 are incorporated herein by reference in their entirety.

INDUSTRIAL APPLICABILITY

The invention is favorably adapted to an application of generating compressed air to drive a pneumatic tool, such as a nailing machine.

The invention claimed is:

1. An air compressor comprising:

a tank part that stores compressed air to be supplied to a pneumatic tool;

a compressed-air generation part for generating the compressed air and supplying the compressed air to the tank part;

a drive part with a motor for driving the compressed-air generation part;

a pressure sensor for detecting an air pressure inside the tank part; and a control circuit part for controlling the motor of the drive part based on a detection signal from the pressure sensor, wherein the control circuit part:

stops operating the motor when a detected pressure indicating the air pressure in the tank part acquired from the detection signal is higher than a maximum set pressure value, sets, as restart set pressure values, a first restart set pressure value and a second restart set pressure value lower than the first restart set pressure value, operates the motor at a first predetermined revolving speed if a pressure drop rate calculated based on the detected pressure is greater than a set pressure drop rate and when the detected pressure drops from the maximum set pressure value to or below the first restart set pressure value, operates the motor at a second predetermined revolving speed that is lower than the first predetermined revolving speed if the pressure drop rate is less than the set pressure drop rate and when the detected pressure drops from the maximum set pressure value to or below the second restart set pressure value, and forcibly operates the motor at the first predetermined set revolving speed independent of the pressure drop rate, when the detected pressure becomes equal to or less than a minimum set pressure value, independent of the operation of the motor, and does so until the detected pressure reaches the maximum set pressure value.

2. An air compressor comprising:

a tank part that stores compressed air to be supplied to a pneumatic tool;

a compressed-air generation part for generating the compressed air and supplying the compressed air to the tank part;

a drive part with a motor for driving the compressed-air generation part;

a pressure sensor for detecting an air pressure inside the tank part; and a control circuit part for controlling the motor of the drive part based on a detection signal from the pressure sensor, wherein the control circuit part:

stops operating the motor when a detected pressure indicating the air pressure in the tank part acquired from the detection signal is higher than a maximum set pressure value, sets, as restart set pressure values, a first restart set pressure value and a second restart set pressure value lower than the first restart set pressure value, operates the motor at a first predetermined revolving speed if a pressure drop rate calculated based on the detected pressure is greater than a set pressure drop rate, operates the motor at a second predetermined revolving speed that is lower than the first predetermined revolving speed if the pressure drop rate is less than the set pressure drop rate, and forcibly operates the motor at the first predetermined set revolving speed independent of the pressure drop rate, when the detected pressure becomes equal to or less than a minimum set pressure value, independent of the operation of the motor, and does so until the detected pressure reaches the maximum set pressure value.

* * * * *